US006642699B1

(12) United States Patent
Gregoire, Jr.

(10) Patent No.: US 6,642,699 B1
(45) Date of Patent: Nov. 4, 2003

(54) BANDGAP VOLTAGE REFERENCE USING DIFFERENTIAL PAIRS TO PERFORM TEMPERATURE CURVATURE COMPENSATION

(75) Inventor: Bernard Robert Gregoire, Jr., Pocatello, ID (US)

(73) Assignee: AMI Semiconductor, Inc., Pocatello ( * ) Notice: Subject to any disclaimer, the term of this patent is extended or adjusted under 35 U.S.C. 154(b) by 0 days.

(21) Appl. No.: 10/134,108

(22) Filed: Apr. 29, 2002

(51) Int. Cl.[7] ..... G05F 3/16
(52) U.S. Cl. ..... 323/314; 323/316; 323/907
(58) Field of Search ..... 323/313, 314, 323/315, 316, 907

(56) References Cited

U.S. PATENT DOCUMENTS

| | | | | | |
|---|---|---|---|---|---|
| 4,250,445 | A | * | 2/1981 | Brokaw | 323/313 |
| 4,346,344 | A | * | 8/1982 | Blauschild | 323/316 |
| 4,348,633 | A | * | 9/1982 | Davis | 323/314 |
| 4,603,291 | A | | 7/1986 | Nelson | 323/315 |
| 4,672,304 | A | | 6/1987 | Degrauwe et al. | 323/314 |
| 4,714,872 | A | * | 12/1987 | Traa | 323/315 |
| 4,808,908 | A | | 2/1989 | Lewis et al. | 323/313 |
| 4,939,442 | A | | 7/1990 | Carvajal et al. | 323/281 |
| 5,325,045 | A | | 6/1994 | Sundby | 323/313 |
| 5,352,973 | A | | 10/1994 | Audy | 323/313 |
| 5,391,980 | A | | 2/1995 | Thiel et al. | 323/314 |
| 5,479,092 | A | | 12/1995 | Pigott et al. | 323/313 |
| 5,521,489 | A | * | 5/1996 | Fukami | 323/907 |
| 5,767,664 | A | | 6/1998 | Price | 323/907 |
| 5,952,873 | A | | 9/1999 | Rincon-Mora | 327/539 |
| 6,124,704 | A | * | 9/2000 | Annema | 323/907 |
| 6,225,856 | B1 | * | 5/2001 | Toth | 323/313 |
| 6,255,807 | B1 | * | 7/2001 | Doorenbos et al. | 323/314 |

* cited by examiner

*Primary Examiner*—Jeffrey Sterrett
(74) *Attorney, Agent, or Firm*—Workman Nydegger

(57) ABSTRACT

A bandgap reference that generates a temperature stable DC voltage by using a corrective current. The corrective current is generated by a series of differential pairs that are controlled by both positive temperature shift gate voltage on one transistor, as well as a negative temperature shift gate voltage on the other transistor. As temperature changes and crosses the crossing point at which the current is split evenly through both transistors, the current change is more abrupt. The crossing points of each of the differential pairs may be appropriately selected so as to generate a high resolution corrective current. The various current contributions are summed to form the total corrective current, which tends to be quite accurate due to the abrupt crossing points. The corrective current is then fed back into the circuit so as to compensate for much of the temperature error.

24 Claims, 6 Drawing Sheets

BANDGAP VOLTAGE REFERENCE USING DIFFERENTIAL PAIRS TO PERFORM TEMPERATURE CURVATURE COMPENSATION

BACKGROUND OF THE INVENTION

1. The Field of the Invention

The present invention relates to the field of bandgap voltage reference circuits. In particular, the present invention relates to circuits and methods for providing a temperature-stable bandgap voltage reference using differential pairs to provide a temperature-curvature compensating current.

2. The Prior State of the Art

The accuracy of circuits often depends on access to a stable Direct Current (DC) reference voltage. One class of circuits that generates DC reference voltages is called "bandgap voltage reference circuits," or "bandgap references" for short. Bandgap references use the bandgap voltage of the underlying semiconductor material (often crystalline silicon) to generate an internal DC reference voltage that is based on the bandgap voltage.

Many bandgap references forward bias the base-emitter region of a bipolar transistor to form a voltage $V_{BE}$ across its base-emitter region. $V_{BE}$ is then used to generate the internal DC reference voltage. $V_{BE}$ does, however, have some first-order, second-order and higher order temperature dependencies. Many bandgap references substantially eliminate the first-order temperature dependency by adding a Proportional-To-Absolute-Temperature (PTAT) voltage to $V_{BE}$.

One such bandgap voltage reference circuit is disclosed in U.S. Pat. No. 3,887,863 (hereinafter referred to as the '863 patent), which issued Jun. 3, 1975 to A. P. Brokaw. The bandgap voltage reference circuit disclosed in the '863 patent relies upon a bandgap cell that is commonly referred to as a "Brokaw cell".

Referring to FIG. 1, a schematic representation of a standard Brokaw cell 100 is shown. The Brokaw cell 100 comprises a pair of bipolar transistors (Q1 and Q2) and a pair of resistors ($R_1$ and $R_2$). The area of the base-emitter regions in Q1 and Q2 are indicated by A and unity, respectively, wherein A is greater than unity.

Referring to FIG. 2, a schematic representation of a bandgap voltage reference circuit 200 is shown incorporating a Brokaw cell 100. In addition to the Brokaw cell 100, the bandgap voltage reference circuit 200 comprises an operational transresistance amplifier R, as well as a pair of resistors $R_3$ and $R_4$ that allow the reference output voltage ($V_{OUT}$) to exceed the bandgap voltage.

During operation, a voltage of $V_{BE}$ develops across the base-emitter region of bipolar transistor Q2. In addition, a PTAT voltage (termed $V_{PTAT}$) develops across resistor $R_2$. The base-emitter voltage ($V_{BE}$) of a bipolar junction transistor has a negative temperature coefficient generally between −1.7 mV/degree C. and −2 mV/degree C. In other words, if the operating temperature of a bipolar transistor was to increase by one degree Celsius, the base-emitter voltage would decrease by a voltage in the range of from 1.7 to 2 mV. In contrast, the PTAT voltage has a positive temperature coefficient. In other words, as the temperature increases, so does the PTAT voltage. By matching the temperature coefficient of $V_{BE}$ of Q2 to the temperature coefficient of $V_{PTAT}$ of R2, the first order temperature coefficient of $V_B$ can be made zero (or at least very close to zero) thereby significantly reducing temperature dependency.

Although the bandgap voltage reference circuit substantially eliminates first-order temperature dependencies in the output voltage, second and higher order temperature dependencies remain. In particular, a plot with temperature on the x-axis and output voltage on the y-axis results in an approximately parabolic curve that reaches a maximum at about the ambient temperature of the bandgap reference.

Some conventional bandgap references even substantially reduce much of the second and higher order temperature variations in the output voltage. One such bandgap voltage reference circuit is disclosed in U.S. Pat. No. 5,767,664 (hereinafter referred to as the '664 patent), which issued Jun. 16, 1998 to B. L. Price. FIG. 3 illustrates such a bandgap reference 300.

The bandgap reference 300 includes the conventional bandgap reference 200 of FIG. 2, but also includes a V-to-I converter circuit 304 with two differential pair segments 306 made up of MOSFETs M1–M4. A current mirror 308 is formed with MOSFETs M5 and M6 so as to extract a correction current, $I_{CORR}$, from the $V_B$ node. The correction current reduces a significant portion of the remaining temperature dependencies that were present in the bandgap reference 200. Accordingly, the voltage at node $V_B$ is relatively temperature stable. As a consequence, the output voltage of the bandgap reference 300 is a DC voltage that is relatively stable with temperature changes as compared to the prior bandgap reference 200.

In order for the correction current to reduce temperature errors, the differential pairs 306 are tuned to provide an appropriate current component at given temperatures. One current source 308 is provided for each differential pair 306. A PTAT voltage is applied to the gate terminal of the left MOSFET in each differential pair (e.g., M1 for differential pair 306', and M3 for differential pair 306"). A substantially constant voltage is tapped onto the gate terminal of the right MOSFET in each differential pair (e.g., M2 for differential pair 306', and M4 for differential pair 306"). As the temperature varies the voltage applied to the gate of the left MOSFET in each differential pair will change. Note that the relatively constant voltage applied to the gate of MOSFET M2 will be lower that the relatively constant voltage applied at the gate of MOSFET M4 due to the voltage division provided by resistors $R_{4A}$, $R_{4B}$ and $R_{4C}$.

Each of the differential pairs 306 generates a component of the correction current. For example, consider the differential pair 306' which contributes a component of the correction current. At very low temperatures, the gate voltage of MOSFET M1 is lower than the gate voltage at M2. Accordingly, most of the current $I_1$ is diverted through M1 to contribute to $I_{CORR}$ via current mirror 308. However, the MOSFET M4 is substantially off. Accordingly, at lower temperatures, the corrective current is approximately proportional to current $I_1$.

As the temperature rises, the gate voltage of M1 becomes the same as the gate voltage of M2. Accordingly, only half of the current $I_1$ would pass through M1 to contribute to curvature correction current $I_{CORR}$. This temperature is often referred to as the "crossing point". At very high temperatures, the gate voltage of M1 is higher than the gate voltage of M2. Accordingly, very little of the current $I_1$ passes through M1 to contribute to the error current.

Accordingly, by adjusting the crossing point of each differential pair, one may change the current contribution profile of each differential pair until the sum of the contributions results in a correction current that generally reduces the temperature error in the output voltage. In FIG. 3, the crossing points are set by fine tuning the size of the resistors $R_{4A}$, $R_{4B}$, and $R_{4C}$.

The bandgap reference 300 provides a significant improvement in the art. However, there is still some degree of temperature dependency in the output voltage, despite the correction current. Accordingly, what are desired are bandgap circuits and methods for more precisely generating a correction current so that temperature dependencies in the generated output current may be even further reduced.

SUMMARY OF THE INVENTION

The foregoing problems in the prior state of the art have been successfully overcome by the present invention, which is directed to bandgap reference circuits and methods that generate a correction current by using differential pairs using positive as well as negative temperature drift voltage sources to perform current steering or diversion in each differential pair.

In accordance with the present invention, a bandgap voltage reference circuit includes a bandgap voltage source that is configured to generate a bandgap voltage during operation, the bandgap voltage having strong temperature dependencies. For example, one bandgap voltage reference source may be a bipolar transistor having a forward-biased base-emitter junction. In that case, the voltage across the base-emitter region ($V_{BE}$) would be a bandgap voltage having heavy temperature dependencies. Such temperature dependencies include first, second, and higher order temperature dependencies. A Proportional-To-Absolute-Temperature (PTAT) voltage source may add a PTAT voltage to the bandgap voltage so as to substantially reduce the first-order temperature dependencies. However, even in that case, second and higher order temperature dependencies would still remain.

The bandgap voltage reference circuit also includes one or more differential pairs. Each differential pair comprises a current source, a voltage source that generates a voltage that has a negative temperature shift (i.e., the voltage reduces as temperature rises), as well as a voltage source that generates a voltage that has a positive temperature shift (i.e., the voltage rises as temperature rises). One of the MOSFETS of the differential pair has its gate terminal coupled to the positive temperature shift voltage, while the other MOSFET has its gate terminal coupled to the negative temperature shift voltage. Accordingly, the principles of the present invention use a positive and negative temperature shift voltage to control current diversion in the differential pairs. This contrasts with the conventional bandgap references that use only the positive temperature shift voltage to control current diversion in differential pairs.

Using both positive and negative temperature shift voltages to control current diversion results in significant advantages. In particular, as temperature rises, not only does one MOSFET turn on, but the other MOSFET also turns off. This results in faster convergence from a total contribution state in which a MOSFET is turned on completely allowing all of the current from the current source to contribute to the correction current, to a zero contribution state in which the MOSFET is turned off completely allowing none of the current from the current source to contribute to the correction current. This allows for better resolution in designing a correction current. Accordingly, more accurate correction currents may be generated to make a more temperature stable output voltage.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

Figure 2:
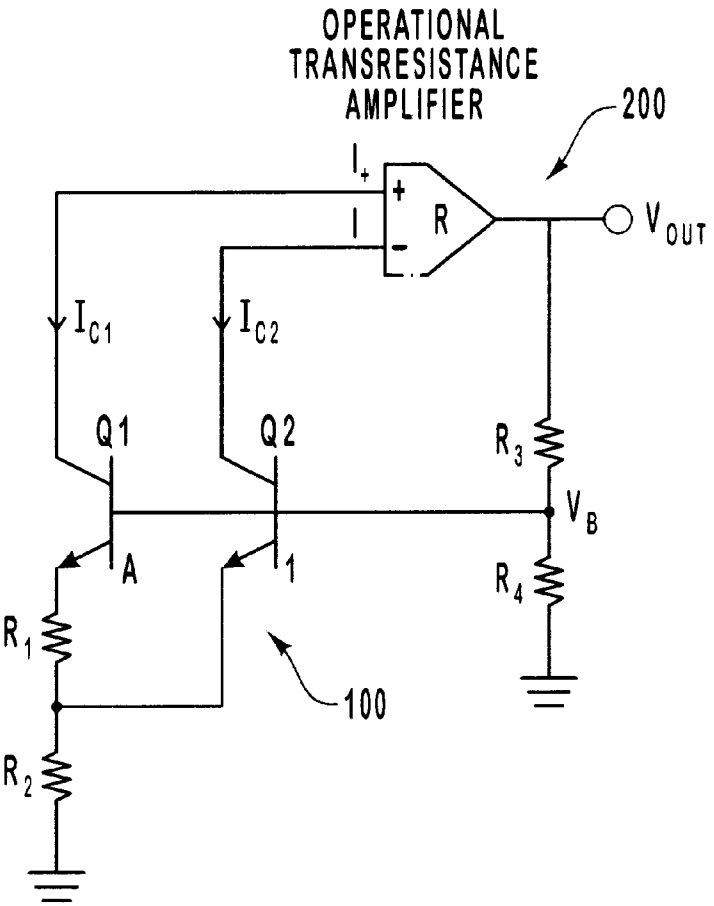
FIG. 2 (PRIOR ART)
FIG. 2 illustrates a conventional bandgap reference that does not use a corrective current in accordance with the prior art.
Figure 1:
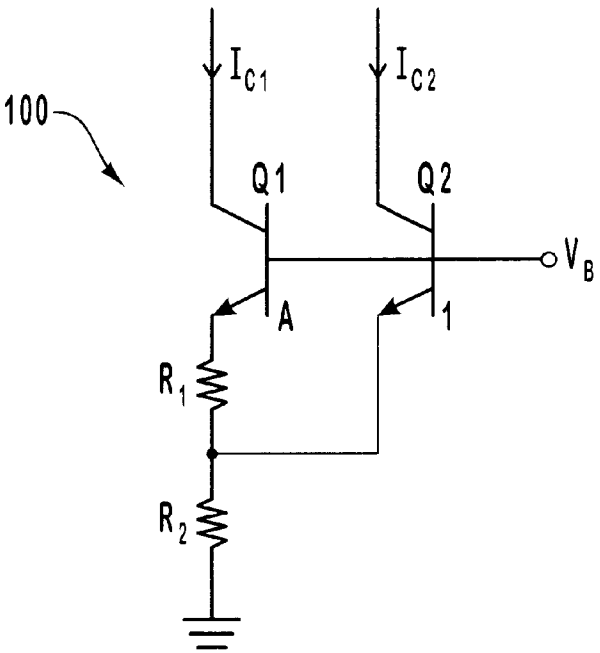
FIG. 1 (PRIOR ART)
FIG. 1 illustrates a conventional bandgap cell that is incorporated into many conventional bandgap references in accordance with the prior art.
Figure 3:
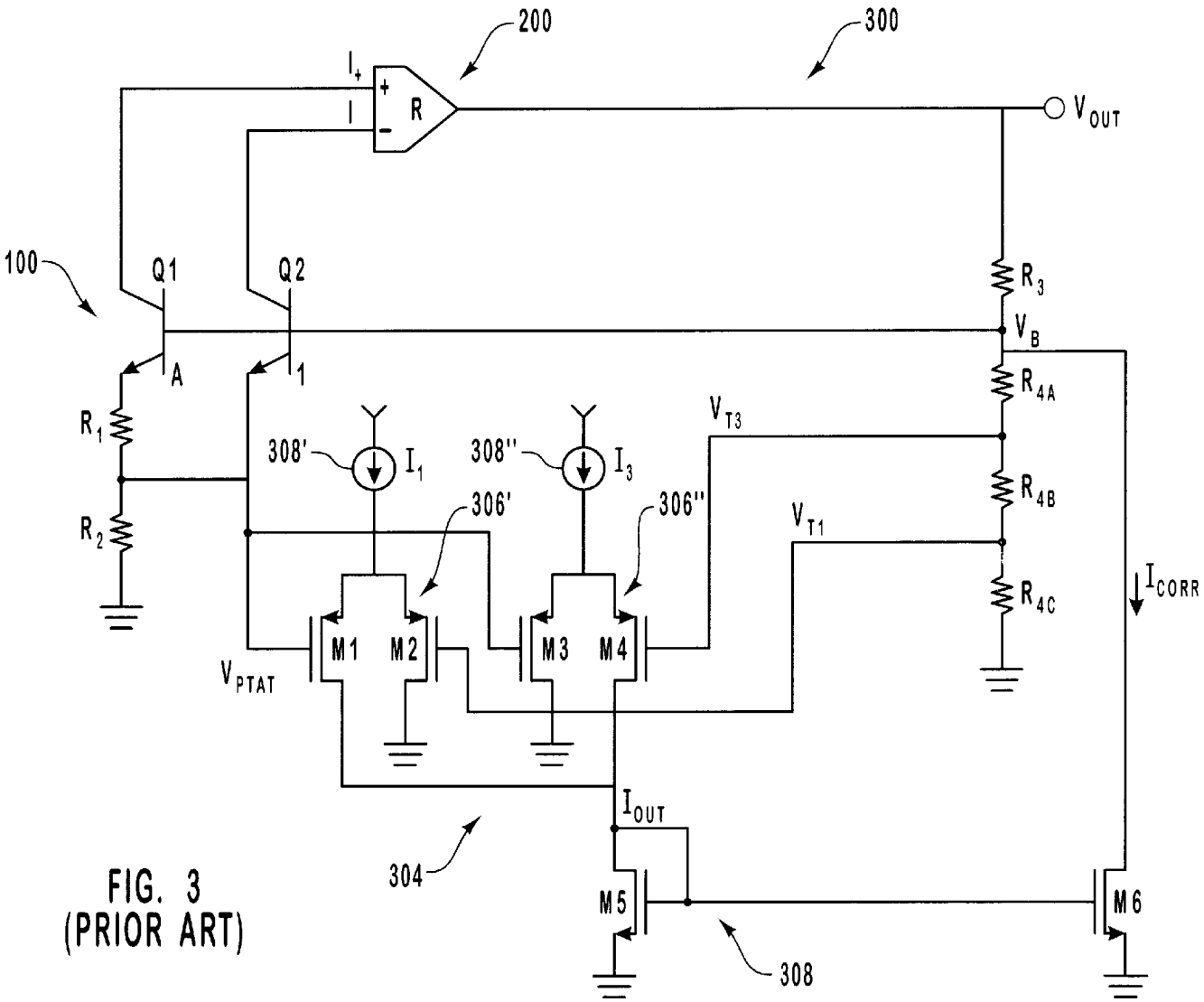
FIG. 3 (PRIOR ART)
FIG. 3 illustrates a conventional bandgap reference that does use a corrective current in accordance with the prior art.
Figure 4:
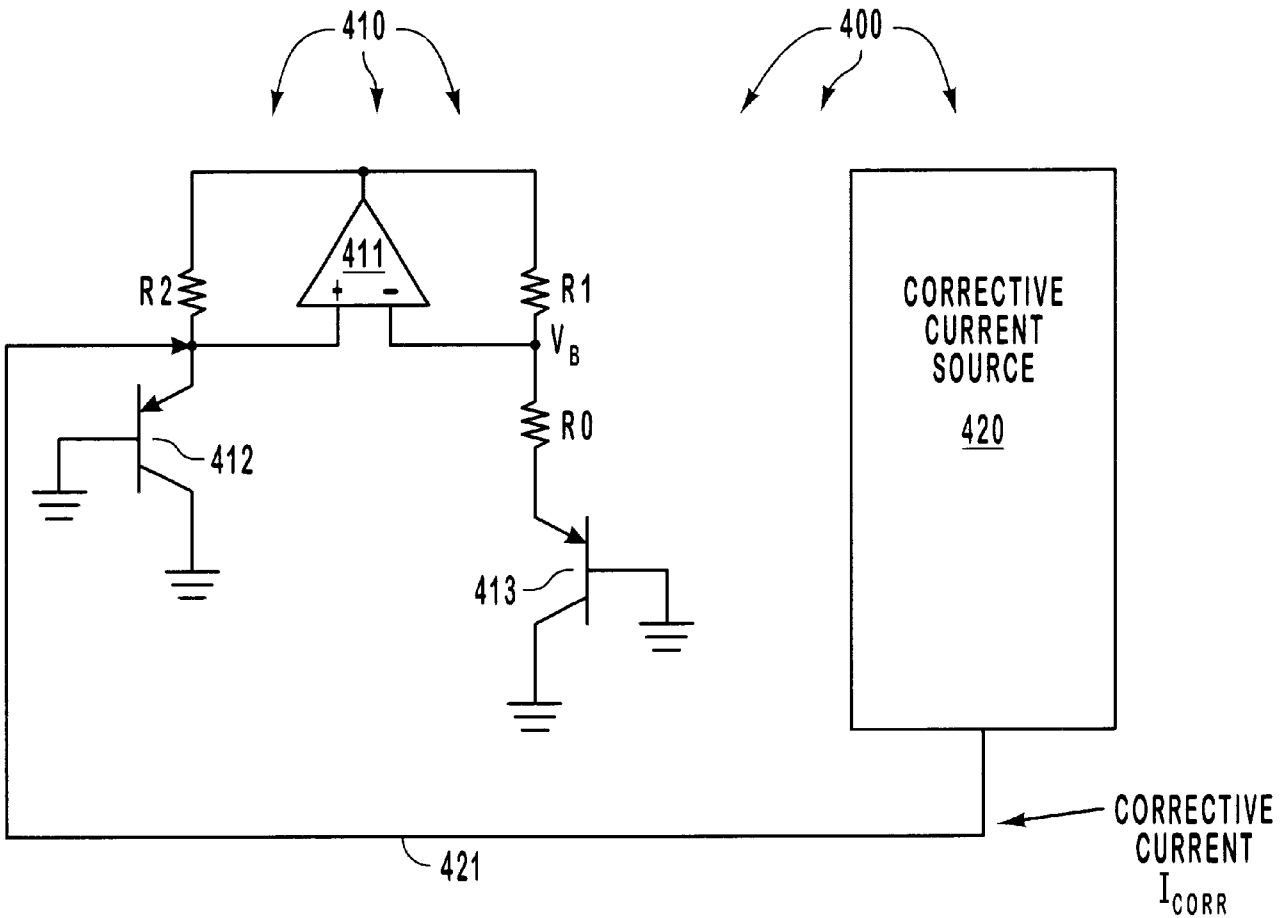
FIG. 4 illustrates a bandgap reference that uses a corrective current in accordance with the present invention.
Figure 6:
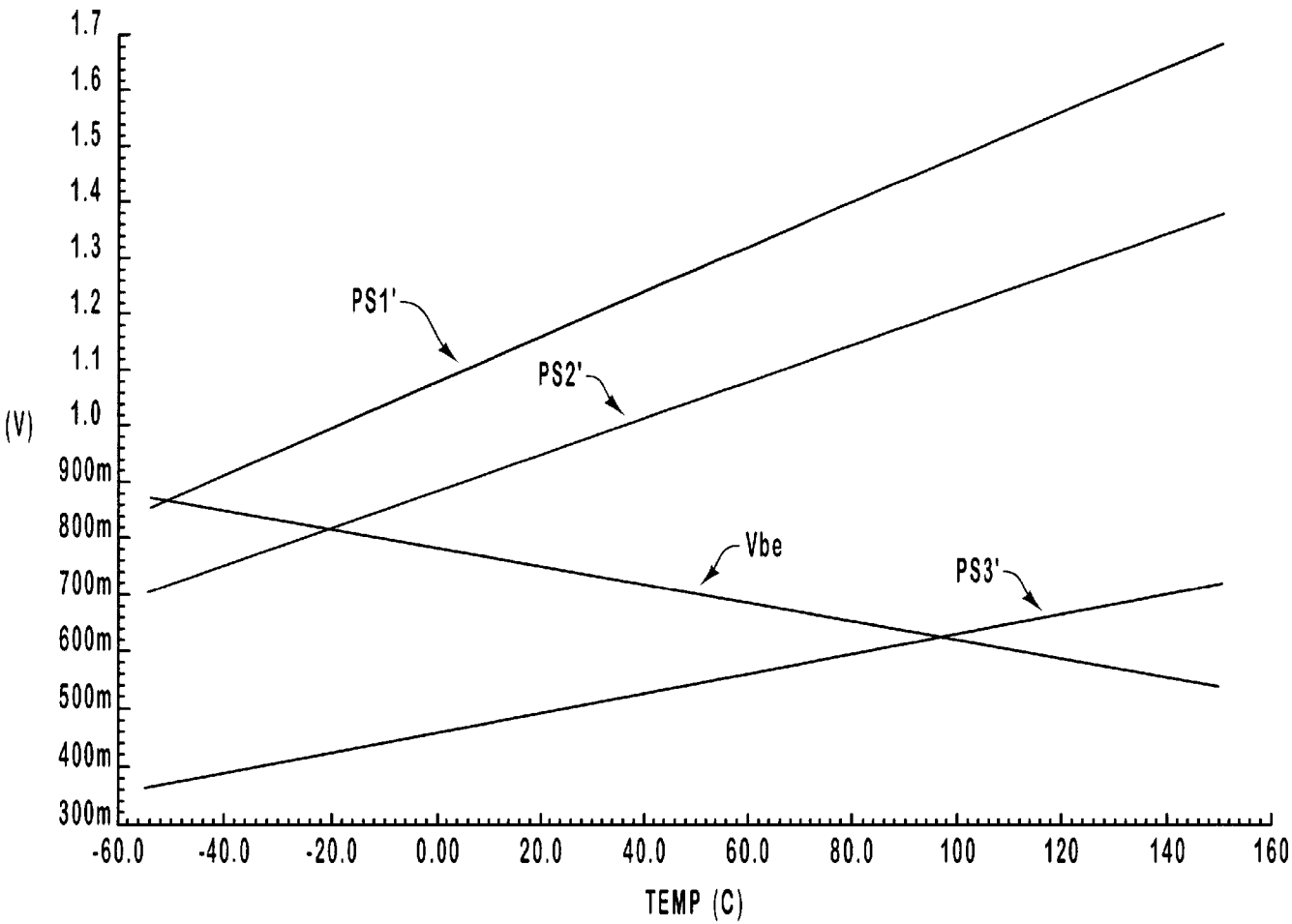
Figure 8:
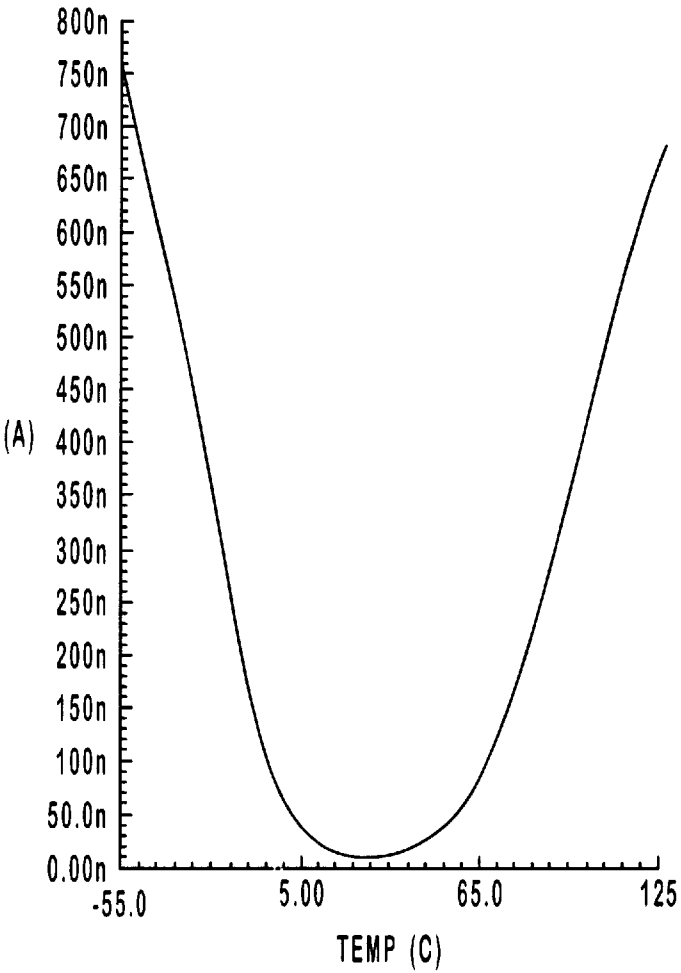
Figure 7:
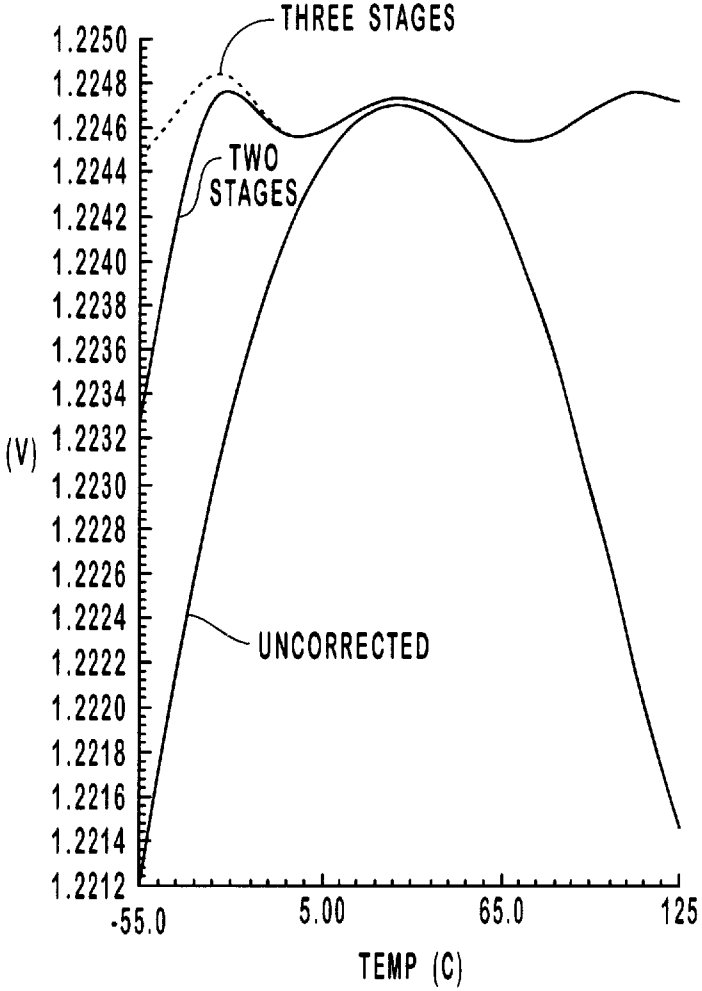

RIG. 5 illustrates the corrective current source of FIG. 4 in further detail illustrating how the differential pairs perform current steering using both positive and negative temperature shift gate voltages;

FIG. 6 illustrates a plot of the temperature dependencies of various gate voltage used when there are three differential pairs that contribute to the corrective current;

FIG. 7 illustrates a plot of the output voltage versus temperature for the uncorrected current having the parabolic shape, a corrected current in which two differential pairs are used to generate the corrective current, and a corrected current in which three differential pairs are used to generate the corrective current; and FIG. 8 illustrates a plot of the corrective current versus temperature when three differential pairs are used to generate the corrective current.

DETAILED DESCRIPTION OF THE PREFERRED EMBODIMENTS

The invention is described below by using diagrams to illustrate either the structure or processing of embodiments used to implement the circuits and methods of the present invention. Using the diagrams in this manner to present the invention should not be construed as limiting of the scope of the invention. Specific embodiments are described below in order to facilitate an understanding of the general principles of the present invention. Various modifications and variations will be apparent to one of ordinary skill in the art after having reviewed this disclosure.

The principles of the present invention relate to a bandgap reference that generates a temperature stable DC voltage.

The bandgap voltage reference circuit includes a bandgap voltage source that is configured to generate a bandgap voltage during operation. The bandgap voltage has a second-order temperature dependency that is compensated for by a corrective current. The corrective current may be generated by a series of one or more differential pairs. Each differential pair includes a current source in which the current is steered through each of the two parallel transistors. Current that passes through one of the transistors contributes to the correction current. The current contributions from each of the one or more differential pairs are added together to generate the total correction current.

By adjusting the crossing point on each of the differential pairs, the correction current may be formed to substantially offset the original temperature error in the output voltage. In addition, since both positive and negative temperature drift voltages are used to steer the current in the differential pairs, each differential pair contributes a higher resolution current component that is more appropriate for the second order parabolic temperature errors generated by conventional bandgap references.

FIG. 4 illustrates a bandgap reference 400 in accordance with the present invention. The bandgap reference 400 includes a bandgap voltage source 410 that is configured to generate a bandgap voltage $V_{BE}$ that has temperature dependencies during operation. The bandgap reference includes an operational amplifier 411 having a positive input terminal coupled to the emitter terminal of a bipolar transistor 412. The base and collector terminals of the bipolar transistor 412 are grounded. The operational amplifier 411 has a positive feedback loop through a resistor R2, and a negative feedback loop through a resistor R1. The node that carries the voltage $V_{BE}$ is coupled to the emitter terminal of a second bipolar transistor 413 via a resistor R0. The base and collector terminals of the bipolar transistor 413 are also grounded.

The bandgap reference 400 uses a corrective current source 420 to generate a corrective current $I_{CORR}$ on a summed current line 421. The summed current line 421 is coupled to the bandgap voltage source 410 so that the corrective current $I_{CORR}$ at least partially compensates for the temperature dependencies present in the bandgap voltage. In the illustrated example, the summed current line 421 is coupled to node A.

Note that there are a wide variety of bandgap references that may be used to generate a bandgap voltage. The illustrated bandgap voltage source 410 is just one example of such a bandgap voltage source. For example, the corrective current may be summed into other locations of the circuit other than the emitter terminal of the bipolar transistor 412 although providing the corrective current directly to the emitter terminal has some advantages in some application. In particular, the corrective current may be larger when feeding the corrective current directly into the emitter terminal, which is advantageous in many applications. The illustrated bandgap voltage source 410 includes an inherent Proportional-To-Absolute-Temperature (PTAT) voltage source that may compensate for first-order temperature dependencies. In particular, in absence of a corrective current, a PTAT voltage is applied across the resistor R2. The resistor R2 may be appropriately sized that the magnitude of the PTAT voltage is such that when added to $V_{BE}$ generated across the base-emitter region of the bipolar transistor 412, the first-order temperature dependencies of the output voltage $V_{OUT}$ are substantially reduced or even eliminated.

Accordingly, without a corrective current, $V_{OUT}$ has only minimal first-order temperature dependencies and is quite stable with temperature. However, second and higher order temperature dependencies would remain absent a corrective current. FIG. 7 includes a plot of three curves. One that is relevant to this description at this point is labeled "uncorrected". This curve is generally parabolic and reaches a maximum at about 30 degrees C. The uncorrected curve is typical of the output voltage generated by many bandgap references that does not employ corrective currents. The vertical axis is minutely scaled because even the uncorrected output voltage is quite stable with temperature ranging between 1.2212 volts and 1.2246 volts. However, it is often desirable to obtain even more stable DC voltage references.

Figure 5:
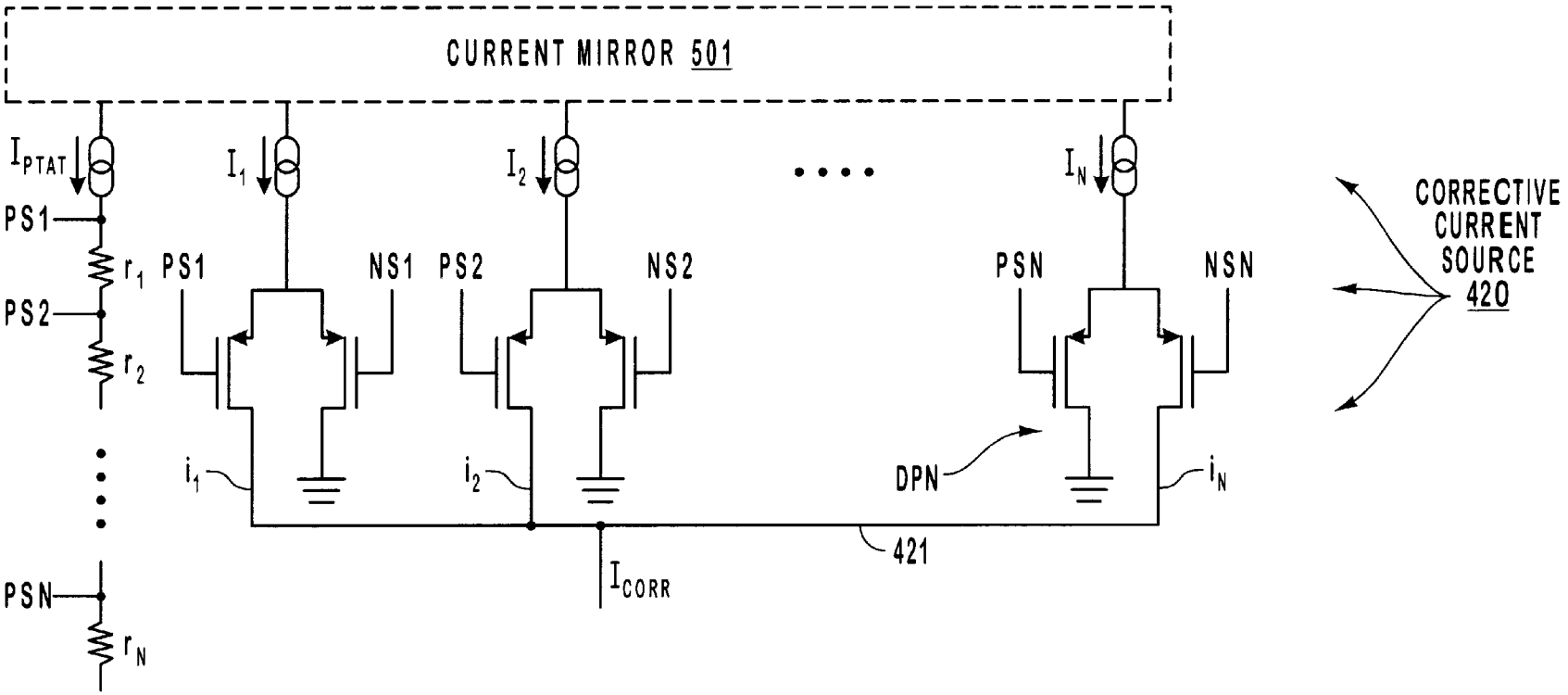

FIG. 5 illustrates the corrective current source 420 in further detail. The corrective current source 420 includes one or more differential pairs DP1 through DPN. The number of differential pairs may be any number of differential pairs from one upwards. In the illustrated example, differential pairs DP1, DP2 and DPN are shown, indicating that there may be N differential pairs, N being an arbitrary whole number. Although the illustrated MOSFETs are illustrated as being PMOS transistors, they may also be NMOS or bipolar transistors with only minor changes to the circuit as one of ordinary skill in the art will appreciate after having reviewed this description.

The left MOSFET in each differential pair DP1 through DPN is controlled by a corresponding gate voltage PS1 through PSN, respectively. The right MOSFET in each differential pair DP1 through DPN is controlled by a corresponding gate voltage NS1 through NSN, respectively. The voltages PSI through PSN have a positive temperature shift. In other words, the voltages PS1 through PSN increase with increasing temperature. In contrast, the voltages NS1 through NSN have a negative temperature shift. In other words, the voltages NS1 through NSN decrease with increasing temperature. The voltages PS1 through PSN may all be the same voltage or may have at least some or all of the voltages being different. The same applies for the voltages NS1 through NSN.

Each differential pair DP1 through DPN includes a current source $I_1$ through $I_N$ These current sources may be generated by a current mirror 501. The currents $I_l$ through $I_N$ need not be the same. It is well-known that different magnitudes of current may be generated by a single current mirror. Some of the differential pairs (e.g., differential pair DP1 and DP2) are used to provide a corrective current component when the temperature is below the nominal temperature. Referring to FIG. 7, the nominal temperature would be the temperature that corresponds to the maximum value of the uncorrected voltage, which occurs at about 33° C. For these differential pairs, current that passes through the right MOSFETs in each differential pair (i.e., transistors NS1 and NS2 in the illustrated example) is provided to a current sink such as ground. On the other hand, current that passes through the left MOSFETs in each of these differential pairs (i.e., transistors DP1 and DP2 in the illustrated example) is provided as a contribution current $i_1$ and $i_2$.

Some of the differential pairs (e.g., differential pair DPN) are used to provide a corrective current component when the temperature is above the nominal temperature. For these differential pairs, current that passes through the left MOSFETs in each differential pair (i.e., transistor PSN in the illustrated example) is provided to a current sink such as ground. On the other hand, current that passes through the right MOSFETs in each of these differential pairs (i.e., transistor NSN in the illustrated example) is provided as a contribution current $i_N$. The various contributions currents $i_1$ through $i_N$ are summed together to generate a corrective current $I_{CORR}$.

In the illustrated example, the positive temperature shift voltages PS1 through PSN are different having been tapped from different nodes in a series of resistors. In particular, a PTAT current ($I_{PTAT}$) is passed through a series of resistors $r_1$ through $r_N$. The voltage PS1 is tapped from the node just above the resistor $r_1$, PS2 is tapped from the node just above the resistor $r_2$, and so forth concluding with node PSN being tapped from the node just above the resistor $r_N$. The negative temperature shift voltages NS1 through NSN may be $V_{BE}$ having been tapped from the node labeled $V_{BE}$ in FIG. 4. However, the negative temperature shift voltages may also be made different using voltage division.

The corrective current should closely match the second order temperature error in the output voltage in order to be most useful. In order to shape the corrective current, a designer may set the crossing points associated with the differential pair at particular values since the shape of the corrective current is largely dictated by the crossing points. To illustrate this principle, take as an example a corrective current source that has three differential pairs. The positive temperature shift gate voltages PS1', PS2' and PS3' are generated by voltage division in which a 5 microamp PTAT current source is supplied through a resistor $r_1$ having a resistance of about 12.4 kohms, a resistor $r_2$ having a resistance of about 26.7 ohms, and a resistor $r_3$ having a resistance of about 29.1 kohms. The negative temperature shift gate voltages are all the same in this example and are tapped from the node labeled $V_{BE}$ in FIG. 4.

FIG. 6 illustrates a plot of the temperature versus voltage for the positive temperature shift gate voltages PS1', PS2' and PS3', and for the negative temperature shift gate voltage $V_{BE}$. This results in a corrective current having a temperature profile shown in FIG. 8. Note that the corrective current of FIG. 8 generally mirrors the parabolic shape of the uncorrected output voltage of FIG. 7. The net result when the corrective current is fed back into the bandgap voltage source 410 is a generally temperature stable voltage that represented by the curve of FIG. 7 labeled "three stages". The curve labeled "two stages" represents a temperature profile had only two differential pair stages been used to generate the corrective current. The use of two differential pair stages also provides a relatively stable temperature profile for most operating temperatures. In one example implementation, four differential pairs are used with two having crossing points below the temperature of the maximum uncorrected output voltage, and with two having crossing points above the temperature of the maximum uncorrected output voltage.

The exact value for the crossing points will depend on the how much current bias there is for each differential pair, and how many differential pairs there are. By adjusting the size of the resistors in the voltage division series of resistors that are used to generate the various temperature shift gate voltages, the crossing points may be adjusted. This, in turn, affects the shape of the corrective current. A simulator may thus be used to quickly derive crossing points that are suitable to generate the corrective current given the conditions that exist with a particular bandgap reference circuit.

Referring to FIG. 7, note that the output voltage ranges only plus or minus 100 microvolts for temperature ranges between −55 degrees C. and +125 degrees C. The use of a negative temperature shift gate voltage as well as a positive temperature gate shift voltage allows for more abrupt changes in each differential pair's contribution to the corrective current at about the crossing point of the differential pair. Accordingly, more accurate representations of the corrective current may be obtained resulting in an improvement to the temperature stability of the bandgap reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A bandgap voltage reference circuit comprising the following:

a bandgap voltage source configured to generate a bandgap voltage during operation of the bandgap voltage reference circuit, the bandgap voltage having temperature dependencies;

one or more differential pairs each comprising the following:

a current source;

a negative temperature shift voltage source that has a negative temperature shift;

a positive temperature shift voltage source that has a positive temperature shift;

a current line configured to carry an error current contribution from the differential pair during operation;

a first transistor having a first terminal connected to the current source, having a second terminal connected to the current line, and having a control terminal that is connected to one of the negative temperature shift voltage source or the positive temperature shift voltage source, wherein the current passing from the first terminal to the second terminal is controlled by the voltage at the control terminal; and a second transistor having a first terminal connected to the current source, having a second terminal connected to a current sink, and having a control terminal that is connected to the other of the negative temperature shift voltage source or the positive temperature shift voltage source, wherein the current passing from the first terminal of the second transistor to the second terminal of the second transistor is controlled by the voltage at the control terminal of the second transistor, wherein the current line from each of the one or more differential pairs are connected together to form a summed current line that carries a total corrective current, wherein the summed current line is coupled, directly or indirectly, to the bandgap voltage source so as to at least partially compensate for the temperature dependencies present in the bandgap voltage.

2. A bandgap voltage reference circuit in accordance with claim 1, further comprising the following:

a PTAT voltage source coupled, directly or indirectly, to the bandgap voltage source so as to at least partially compensate for first order components of the temperature dependencies.

3. A bandgap voltage reference circuit in accordance with claim 1, wherein the bandgap voltage source comprises a PN junction that is configured to be forward-biased during operation.

4. A bandgap voltage reference circuit in accordance with claim 3, wherein the PN junction is a base-emitter junction of a bipolar transistor.

5. A bandgap voltage reference circuit in accordance with claim 1, wherein the negative temperature shift voltage source for at least some of the one or more differential pairs comprises a base-emitter voltage source.

6. A bandgap voltage reference circuit in accordance with claim 5, wherein the base-emitter voltage source comprises the bandgap voltage source.

7. A bandgap voltage reference circuit in accordance with claim 5, wherein the positive temperature shift voltage source for at least some of the one or more differential pairs comprises a PTAT voltage source.

8. A bandgap voltage reference circuit in accordance with claim 7, further comprising the following:

a PTAT current source;

a series of resistors coupled to the PTAT current source so that each resistor in the series of resistors also has a PTAT current passing through during operation;

wherein the one or more differential pairs comprise the following:

a first differential pair, wherein the control terminal of the second transistor in the first differential pair is connected to a first node in the series of resistors; and a second differential pair, wherein the control terminal of the second transistor in the second differential pair is connected to a second node in the series of resistors that is different than the first node.

9. A bandgap voltage reference circuit in accordance with claim 1, further comprising the following:

a PTAT current source;

a series of resistors coupled to the PTAT current source so that each resistor in the series of resistors also has a PTAT current passing through during operation;

wherein the one or more differential pairs comprise the following:

a first differential pair, wherein the control terminal of the second transistor in the first differential pair is connected to a first node in the series of resistors; and a second differential pair, wherein the control terminal of the second transistor in the second differential pair is connected to a second node in the series of resistors that is different than the first node.

10. A bandgap voltage reference circuit in accordance with claim 1, wherein the one or more differential pairs comprises a single differential pair.

11. A bandgap voltage reference circuit in accordance with claim 1, wherein the one or more differential pairs comprises two or more differential pairs.

12. A bandgap voltage reference circuit in accordance with claim 11, wherein the negative temperature shift voltage source is common for each of the two or more differential pairs.

13. A bandgap voltage reference circuit in accordance with claim 11, wherein the negative temperature shift voltage source is different for at least some of the two or more differential pairs.

14. A bandgap voltage reference circuit in accordance with claim 11, wherein the positive temperature shift voltage source is common for each of the two or more differential pairs.

15. A bandgap voltage reference circuit in accordance with claim 11, wherein the positive temperature shift voltage source is different for at least some of the two or more differential pairs.

16. A bandgap voltage reference circuit in accordance with claim 11, wherein the two or more differential pairs comprises three or more differential pairs.

17. A bandgap voltage reference circuit in accordance with claim 11, wherein the three or more differential pairs comprises four or more differential pairs.

18. A bandgap voltage reference circuit in accordance with claim 1, wherein the first transistor and the second transistor for at least one of the one or more differential pairs are NMOS transistors.

19. A bandgap voltage reference circuit in accordance with claim 1, wherein the first transistor and the second transistor for each of the one or more differential pairs are NMOS transistors.

20. A bandgap voltage reference circuit in accordance with claim 1, wherein the first transistor and the second transistor for at least one of the one or more differential pairs are PMOS transistors.

21. A bandgap voltage reference circuit in accordance with claim 1, wherein the first transistor and the second transistor for each of the one or more differential pairs are PMOS transistors.

22. A bandgap voltage reference circuit in accordance with claim 1, wherein the first transistor and the second transistor for at least one of the one or more differential pairs are bipolar transistors.

23. A bandgap voltage reference circuit in accordance with claim 1, wherein the first transistor and the second transistor for each of the one or more differential pairs are bipolar transistors.

24. A bandgap voltage reference circuit in accordance with claim 1, further comprising the following:

a current mirror, wherein the current source for each of the one or more differential pairs are mirrored from the current mirror.

* * * * *

UNITED STATES PATENT AND TRADEMARK OFFICE

CERTIFICATE OF CORRECTION

PATENT NO. : 6,642,699 B1
DATED : November 4, 2003
INVENTOR(S) : Bernard Robert Gregoire, Jr.

It is certified that error appears in the above-identified patent and that said Letters Patent is hereby corrected as shown below:

Title page,
Item [56], References Cited, U.S. PATENT DOCUMENTS, *Primary Examiner*, after "Jeffrey" insert -- L. --

Column 5,
Line 53, change "application" to -- applications --

Signed and Sealed this

Thirteenth Day of April, 2004

JON W. DUDAS
*Acting Director of the United States Patent and Trademark Office*